US006149210A

United States Patent [19]

Hunt et al.

[11] Patent Number: 6,149,210

[45] Date of Patent: Nov. 21, 2000

[54] HOOD LATCH FOR AN ENGINE COMPARTMENT

[75] Inventors: Trevor Hunt, Bolton; Ravi Joshi, Markham; Dikran Ghorghorian, Scarborough; Kris Tomaszewski, Markham, all of Canada

[73] Assignee: Atoma International Corporation, Aurora, Canada

[21] Appl. No.: 09/319,563

[22] PCT Filed: Dec. 10, 1997

[86] PCT No.: PCT/CA97/00941

§ 371 Date: Aug. 16, 1999

§ 102(e) Date: Aug. 16, 1999

[87] PCT Pub. No.: WO98/26144

PCT Pub. Date: Jun. 18, 1998

[30] Foreign Application Priority Data

Dec. 10, 1996 [CA] Canada ..... 2192527

[51] Int. Cl.[7] ..... E05C 3/06

[52] U.S. Cl. ..... 292/216; 292/336.3; 292/DIG. 14

[58] Field of Search ..... 292/216, DIG. 14, 292/336.3, 214

[56] References Cited

U.S. PATENT DOCUMENTS

| | | | |
|---|---|---|---|
| 3,905,627 | 9/1975 | Fujita | 292/216 |
| 4,875,724 | 10/1989 | Gruber | 292/216 |
| 4,917,417 | 4/1990 | Aubry | 292/117 |
| 4,917,420 | 4/1990 | Rogers, Jr. | 292/198 |
| 4,961,601 | 10/1990 | Lindholm et al. | 292/216 |
| 4,991,884 | 2/1991 | Cairns | 292/28 |
| 5,000,493 | 3/1991 | Bastien | 292/11 |
| 5,046,768 | 9/1991 | Myslicki | 292/68 |
| 5,048,877 | 9/1991 | Rogers, Jr. et al. | 292/110 |
| 5,118,146 | 6/1992 | Watanuki | 292/216 |
| 5,141,265 | 8/1992 | Claar et al. | 292/30 |
| 5,158,330 | 10/1992 | Weyerstall et al. | 292/144 |
| 5,297,010 | 3/1994 | Camarota et al. | 362/80 |
| 5,618,069 | 4/1997 | Konchan et al. | 292/216 |
| 5,722,706 | 3/1998 | Bartel et al. | 292/216 |
| 5,853,060 | 12/1998 | Chao et al. | 180/69.2 |

FOREIGN PATENT DOCUMENTS

| | | |
|---|---|---|
| 4224982 | 2/1994 | Germany . |
| 4313570 | 10/1994 | Germany . |

*Primary Examiner*—B. Dayoan
*Assistant Examiner*—Clifford B Vaterlaus
*Attorney, Agent, or Firm*—Howard & Howard

[57] ABSTRACT

A hood latch assembly (10) has a housing (14) having a mouth (13). A ratchet (16) is pivotally mounted within the housing (14) to cooperate with the mouth (13) to pivot between an open, a secondary closed and a primary closed condition for receiving, engaging and cinching a keeper of a striker (80). The ratchet (16) is biased to the open condition. A pivotally mounted primary pawl (18) is biased for engagement with the ratchet (16) to releasably retain the ratchet (16) in the primary closed condition. A pivotally mounted secondary pawl (62) is biased for engagement with the ratchet (16) to releasably retain the ratchet (16) in the secondary closed condition. The secondary pawl (62) has a release lever (20) which rotates between a deployed position and a retracted position. As the ratchet (16) engages the striker (80), the ratchet (16) will rotate in a latching sense from the open condition to the secondary closed condition. As the ratchet (16) further rotates from the secondary closed to the primary closed condition, fully engaging the striker (80), the secondary pawl (62) follows the ratchet (16), allowing the release lever (20) to rotate from a deployed position to a retracted position. Upon release of the primary engagement by disengaging the primary pawl (18), the ratchet (16) will rotate from the primary closed to the secondary closed condition. The secondary pawl (62) will follow the ratchet (16) rotating the release lever (20) from the retracted position to the deployed position. The operator then manipulates the release lever (20) to release the ratchet (16), allowing the ratchet (16) to rotate from the secondary closed to the open condition.

17 Claims, 4 Drawing Sheets

HOOD LATCH FOR AN ENGINE COMPARTMENT

FIELD OF INVENTION

This invention relates to a hood latch for a vehicle. In particular, this invention relates to a hood latch having a retracting secondary release arm and a light operable on release of a primary release.

BACKGROUND OF INVENTION

Vehicle hood latch systems are well known in the art. Typically, a vehicle hood or trunk deck will have a latch for engaging and cinching onto a striker. The latch will have a rotatably mounted ratchet engaging a pawl in a ratchet relation. The ratchet cooperates with a mouth of the housing to pivot between an open and closed condition for receiving, engaging and cinching a keeper of a striker. The pawl retains the ratchet in the closed and cinched conditions.

Hood latches are required to have a secondary latching mechanism and a primary latching mechanism. The primary latching mechanism is operably from inside the vehicle, normally under the dashboard. A secondary latching is only operable from the outside.

It is known to provide a release lever on the secondary latching mechanism which is presented only upon the release of the primary latch. Examples of such latch mechanism are described in U.S. Pat. Nos. 4,961601; 4,991,884; 5,000,493 and 5,141,265. In these latch mechanisms, the secondary latching mechanism is separate from the primary latching mechanism, requiring additional components and labor for assembly.

In many cases, the location of the arm is difficult to find requiring the operator to probe blindly or bend over to look for the arm. Since the exact location of the handle varies from manufacturer to manufacturer, there exists a need to provide a secondary release lever which is readily accessible and visible to the operator when the hood latch is in the secondary position.

SUMMARY OF THE INVENTION

The disadvantages of the prior art may be overcome by providing a hood latch assembly for a vehicle having a simple mechanism for self presenting a secondary release arm upon releasing of the primary release and which retracts upon closure of the hood.

It is desirable to provide a hood latch having a light which will illuminate once the secondary release arm is positioned for activation.

According to one aspect of the invention, there is provided a hood latch assembly having a housing having a mouth. A ratchet is pivotally mounted within the housing to cooperate with the mouth to pivot between an open, a secondary closed and a primary closed condition for receiving, engaging and cinching a keeper of a striker. The ratchet is biased to the open condition. A pivotally mounted primary pawl is biased for engagement with the ratchet to releasably retain the ratchet in the primary closed condition. A pivotally mounted secondary pawl is biased for engagement with the ratchet to releasably retain the ratchet in the secondary closed condition. The secondary pawl has a release lever which rotates between a deployed position and a retracted position. As the ratchet engages the striker, the ratchet will rotate in a latching sense from the open condition to the secondary closed condition. As the ratchet further rotates from the secondary closed to the primary closed condition, fully engaging the striker, the secondary pawl follows the ratchet, allowing the release lever to rotate from a deployed position to a retracted position.

Upon release of the primary engagement by disengaging the primary pawl, the ratchet will rotate from the primary closed to the secondary closed condition. The secondary pawl will follow the ratchet rotating the release lever from the retracted position to the deployed position. The operator then manipulates the release lever to release the ratchet, allowing the ratchet to rotate from the secondary closed to the open condition.

The hood latch has a light which is operably responsive to a ratchet engagement of the primary pawl or alternatively, to the movement of the release arm moving from the retracted position and the deployed position. As the hood latch changes states between the primary closed condition and the secondary closed condition, the switch will open and close. The switch is disposed between a light means mounted to illuminate the hood latch region and a source of electrical power. Opening and closing of the switch will responsively illuminate the light bulb.

DESCRIPTION OF THE DRAWINGS

In drawings which illustrate embodiments of the invention.

DESCRIPTION OF THE INVENTION

Figure 1:
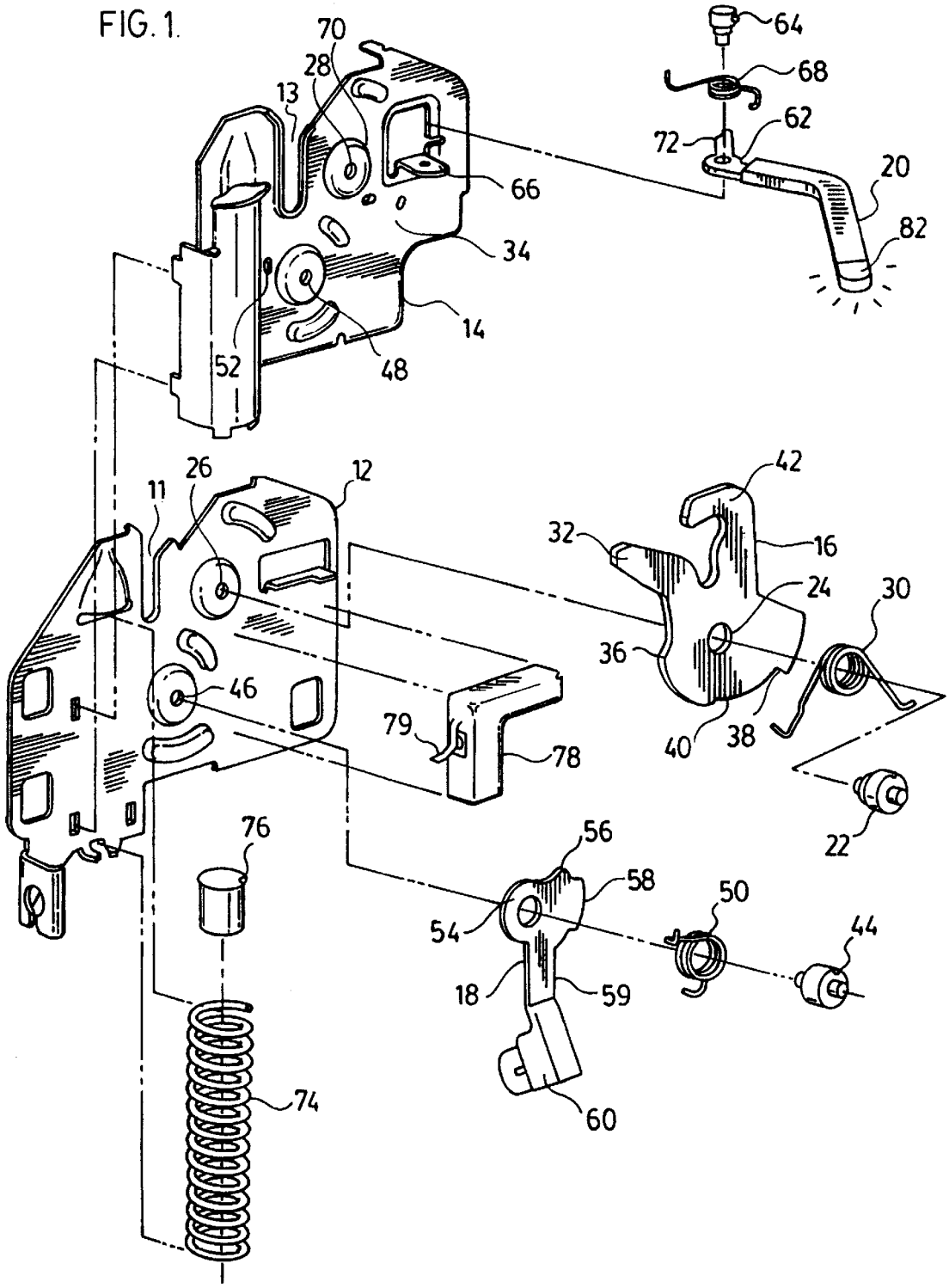
FIG. 1 is an exploded perspective view of the hood latch assembly of the present invention.

The hood latch assembly 10 of the present invention is generally illustrated in FIG. 1. The latch 10 generally comprises a cover plate 12, a housing 14, a ratchet or detent fork 16, a primary pawl 18 and a secondary release arm or lever 20.

Cover plate 12 and housing 14 are preferable stamped from sheet metal and each is shaped and has a series of holes and bosses for receiving the various components as will be described below. Cover plate 12 and housing 14 each has a mouth 11 and 13 respectively.

Detent fork or ratchet 16 is pivotally mounted on pin 22 through aperture 24. Pin 22 extends between aperture 26 on cover plate 12 and aperture 28 on housing 14. Ends of the pin 22 are finished to rivet the cover plate 12 to the housing 14. Spring 30 is concentrically mounted on pin 22. One end of spring 30 engages arm 32 of ratchet, while the other extend through aperture 34 of housing 14, to bias ratchet 16 to the open condition.

Ratchet 16 has a primary detent 36, a secondary detent 38 and a cam surface 40. The cam surface 40 has a circumferential extent having a varying radial length. As the cam surface 40 rotates relative to the secondary release lever 20 in a latching sense, the radial length decreases. Ratchet 16 has a hooking arm 42 which has a distal end which extends substantially tangential to the rotation of ratchet 16. The hook shape of the distal end facilitates gripping of the striker when the hood latch is in a secondary closed condition. The ratchet 16 cooperates with the mouths 11 and 13 to releasably retain a striker mounted on a hood of a vehicle.

Primary pawl 18 is pivotally mounted on pin 44. Pin 44 extends between aperture 46 on cover plate 12 and aperture 48 on housing 14. Ends of the pin 44 are finished to rivet the cover plate 12 to the housing 14. Spring 50 is concentrically mounted on pin 44. One end of spring 50 engages primary pawl 18, while the other extend through aperture 52 of housing 14, to bias primary pawl 18 into ratchet engagement with ratchet 16.

Primary pawl 18 comprises a disc 54 which has an abutment 56 for engaging detent 36 of ratchet 16. Disc 54 also has a switch cam surface 58. Primary pawl 18 has a handle 59 extending from the disc 54. At the distal end of handle 59 is a bowden wire fixture 60 for receiving a bowden wire for activating the primary pawl 18 from inside the vehicle.

Secondary release lever 20 has a secondary pawl 62 which receives pin 64 to pivotally mount secondary release lever 20 onto tab 66 of housing 14. Spring 68 is concentrically mounted on pin 64. One end of spring 68 engages secondary release lever 20, while the other extend through aperture 70 of housing 14, to bias secondary release lever 20 into engagement with ratchet 16.

Secondary pawl 62 has a tab 72 which follows cam surface 40 of ratchet 16 while the latch assembly 10 moves between the primary closed or the secondary closed conditions. Since the radial length of the cam surface 40 varies, the secondary pawl 62 will rotate as the ratchet 16 rotates. Preferably, the change in radial length of cam surface 40 will cause at least 15° of rotation of the secondary release lever 20. The length of the secondary release lever 20 can be selected to provide a desired amount of movement at the distal end thereof.

When the latch assembly 10 is in the secondary closed condition, abutment 38 of ratchet 16 will engage tab 72, resisting rotation of the ratchet 16 in an opening or unlatching sense.

Compression spring 74 has a plug 76 fitted in an upper end thereof. Cover plate 12 and housing 14 each has an arcuate channel for receiving and cradling compression spring 74 in a manner well known in the art. Plug 76 engages arm 32 of ratchet 16 such that spring 74 provides a hood opening bias.

Switch 78 is mounted onto cover plate 12. Switch arm 79 is positioned to engage switch cam surface 58 of primary pawl 18. Switch 78 is electrically connected to a light 82 mounted at a distal end of the secondary release arm 20. Light 82 is preferably mounted at the distal end of secondary release arm 20; however it is readily understood by those skilled in the art that the light 82 may be mounted anywhere on or near the latch assembly 10 to provide illumination to the general region of the secondary release arm 20. Light 82 is preferably an incandescent light bulb, however, other light sources may also be used. Such light sources include LED's and fibre optics.

When the latch assembly 10 is in the primary closed condition, switch arm 79 will extend beyond the end of the switch cam surface, opening the switch 78. When the latch assembly 10 is not in the primary closed condition, switch arm 79 will follow the switch cam surface 58, closing the switch 78.

Figure 2:
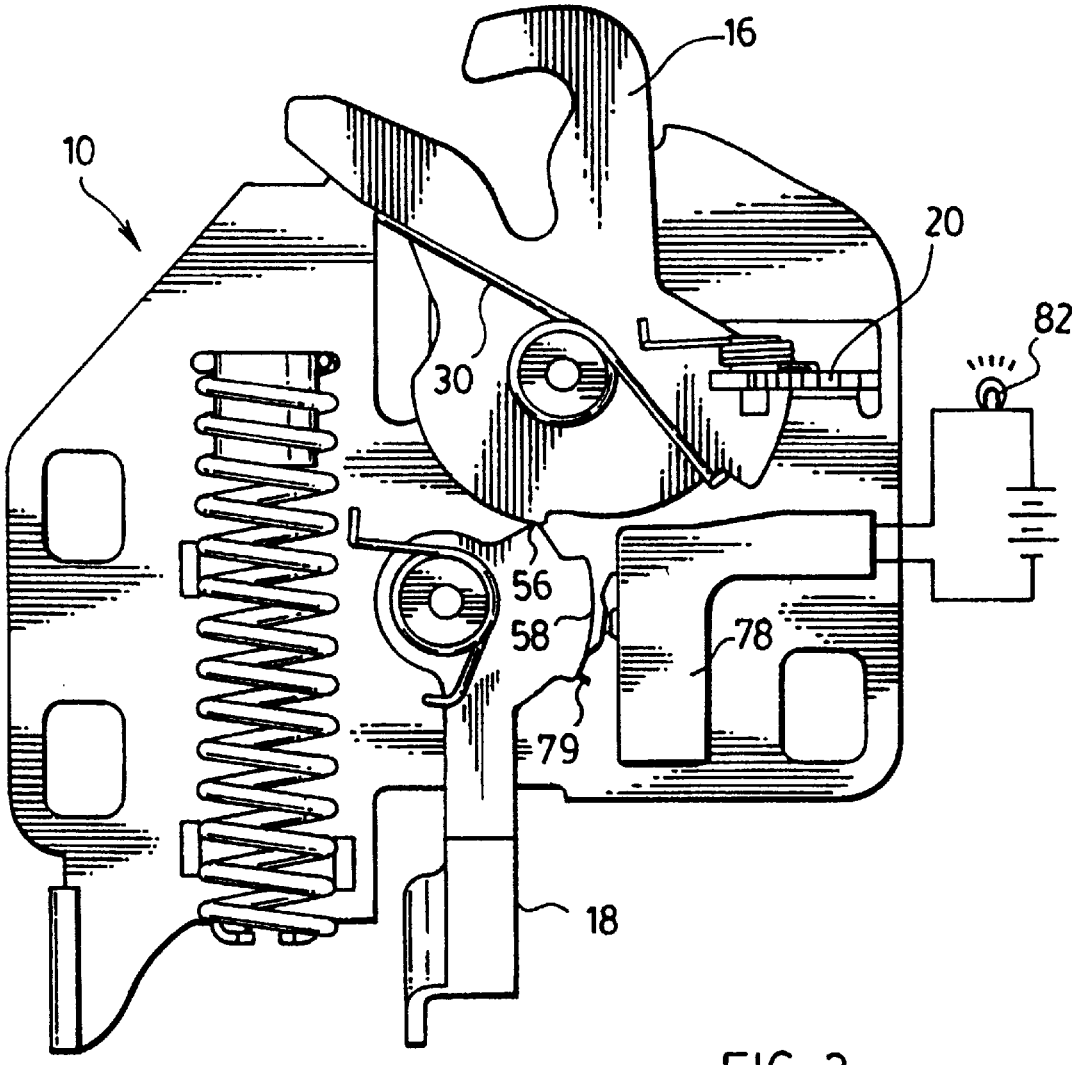
FIG. 2 is an elevational view of the hood latch assembly of FIG. 1 in an open condition.
Figure 3:
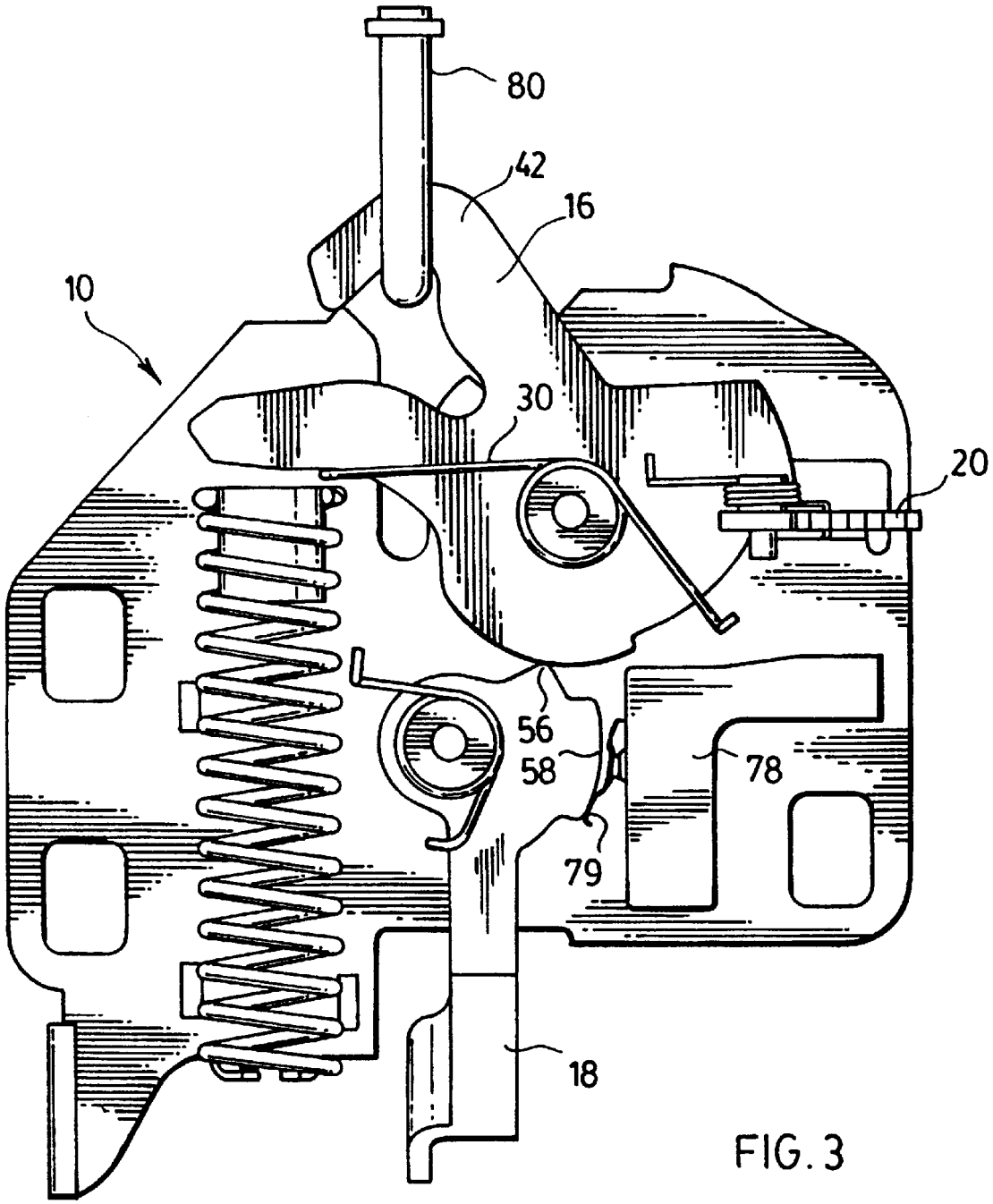
FIG. 3 is an elevational view of the hood latch assembly of FIG. 1 in a secondary closed condition.
Figure 4:
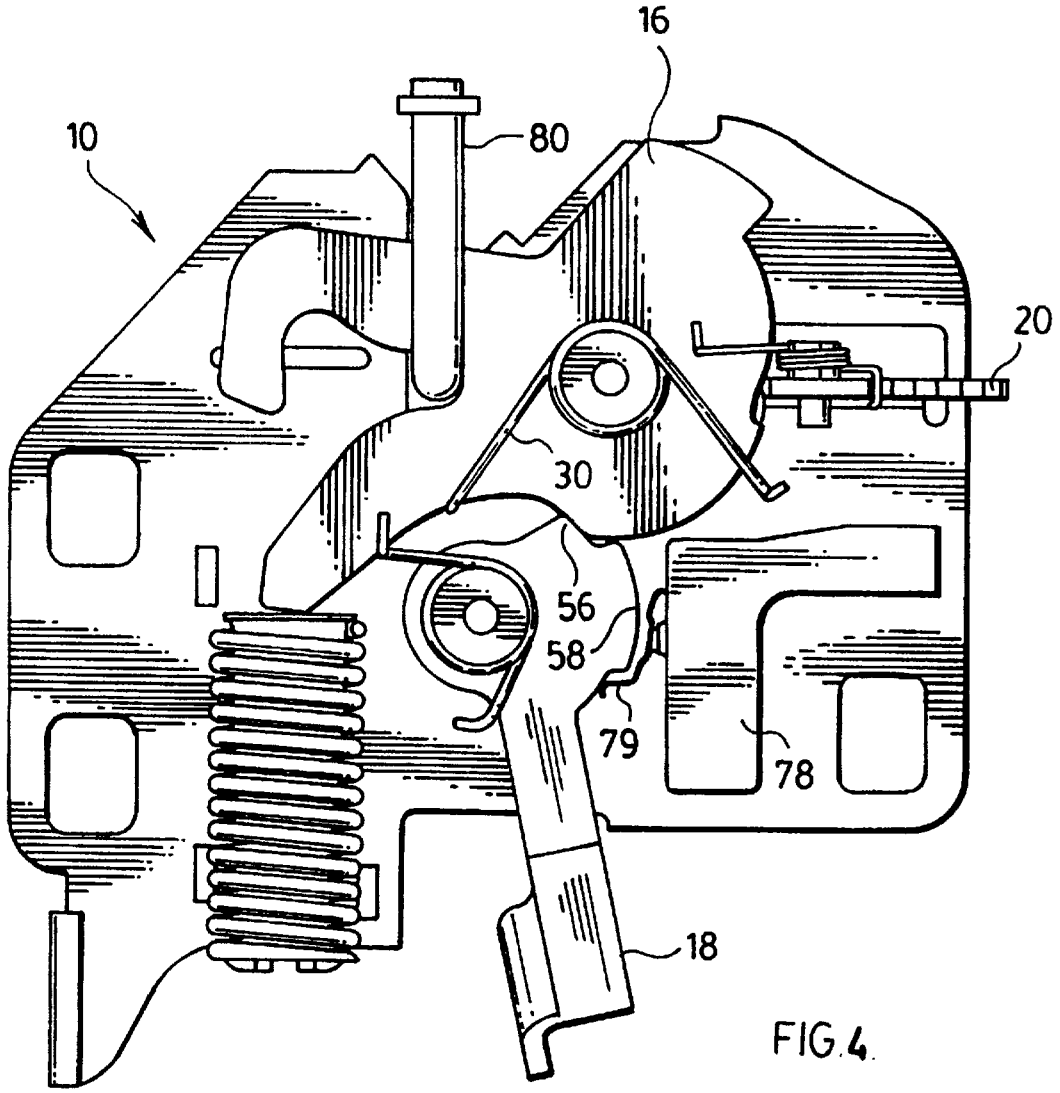
FIG. 4 is an elevational view of the hood latch assembly of FIG. 1 in an primary closed condition.

Referring to FIGS. 2 to 4, the striker 80 will engage arm 32 of ratchet 16 and will slide therealong as the ratchet 16 rotates in a latching sense from the open condition to the secondary closed condition. The abutment 38 will rotate beyond secondary pawl 62 to allow tab 72 to releasably retain the ratchet 16 in the secondary closed condition. In this secondary closed condition, the secondary release lever 20 will be in a deployed position, extending generally forwardly of the latch assembly 10.

Further downward movement of the striker 80 will cause the ratchet 16 to further rotate in a latching sense. Arm 32 will engage plug 76 to compress spring 74. Tab 72 will follow cam surface 40 of ratchet 16, rotating the secondary release lever 20 from the deployed position to the retracted position, wherein the secondary release lever 20 will extend generally in the same plane as the latch assembly 10. Primary pawl 18 will also follow ratchet 16 until abutment 56 engages detent 36, releasably locking the ratchet 16 in the primary closed condition.

Upon release of the primary pawl 18, abutment 56 will disengage ratchet 16. The biasing force of compression spring 74 will rotate the ratchet 16 in a releasing sense until abutment 38 engages tab 72 of secondary pawl 62. Secondary pawl 62 has followed cam surface 40 causing the secondary release lever 20 to rotate from the retracted position to the deployed position. The hooking arm 42 of ratchet 16 will hook onto the striker 80.

Upon release of the secondary release lever 20, secondary pawl 62 will disengage the ratchet 16, allowing the bias of spring 30 to rotate the ratchet 16 to the fully open condition, releasing the striker 80.

The preceding specific embodiment is illustrative of the practice of the present invention. It is to be understood, however, that other expedients known or apparent to those skilled in the art or disclosed herein may be employed without departing from the spirit of the invention.

We claim:

1. A hood latch comprising:

a housing having a mouth, a ratchet pivotally mounted within the housing to cooperate with the mouth to pivot between an open condition, a primary closed condition and a secondary closed condition for receiving, engaging and cinching a keeper of a striker, the ratchet being biased to the open condition, a pivotally mounted primary pawl having biasing means for biasing the primary pawl into engagement with the ratchet for releasably retaining the ratchet in the primary closed condition, a pivotally mounted secondary pawl having biasing means for biasing the secondary pawl into engagement with the ratchet for releasably retaining the ratchet in the secondary closed condition, said secondary pawl having a secondary release arm extending therefrom and said secondary release arm is rotatable between a retracted position when the primary pawl is engaged and a deployed position once the primary pawl has been released, said secondary release arm extending generally in the same plane as the housing when in said retracted position and extending forwardly of said housing when in said deployed position.

2. A hood latch as claimed in claim 1 wherein said hood latch further comprises a light means mounted for illuminating a region forward of the hood latch, said light means turning off and on responsively to the ratchet rotating between the primary closed condition and the secondary closed condition.

3. A hood latch as claimed in claim 2 wherein said ratchet has a cam surface having a varying radial length and said secondary pawl follows said cam surface effecting said movement between the retracted position and the deployed position.

4. A hood latch as claimed in claim 3 wherein said rotatable movement of said secondary release arm between the retracted position and the deployed position is responsive to rotation of said ratchet between the primary closed condition and the secondary closed condition.

5. A hood latch as claimed in claim 4 wherein said light means is mounted at a distal end region of the secondary release arm.

6. A hood latch as claimed in claim 5 wherein said light means comprises a light bulb, means for electrically connecting the light bulb to an electricity source and a switch for opening and closing the electrical connection.

7. A hood latch as claimed in clam 6 wherein said switch is mounted for engagement with the primary release pawl.

8. A hood latch as claimed in claim 4 wherein when said secondary release arm is in the retracted position, said secondary release arm is in a plane generally parallel to said housing and when said secondary release arm is in the deployed position, said secondary release arm is rotated at least 15° thereto.

9. A hood latch as claimed in claim 1 wherein said ratchet has a cam surface having a varying radial length and said secondary pawl follows said cam surface effecting said movement between the retracted position and the deployed position.

10. A hood latch as claimed in claim 9 wherein said rotatable movement of said secondary release arm between the retracted position and the deployed is responsive to rotation of said ratchet between the primary closed condition and the secondary closed condition.

11. A hood latch as claimed in claim 10 wherein when said secondary release arm is in the retracted position, said secondary release is in a plane generally parallel to said housing and when said secondary release arm is in the deployed position, said secondary release arm is rotated at least 15° thereto.

12. A hood latch as claimed in claim 1 wherein when said ratchet has an arm for engaging a striker as the ratchet is rotated in a latching sense, and a hooking arm for engaging a striker when the ratchet is in a secondary closed condition.

13. A hood latch as claimed in claim 12 wherein said ratchet has a cam surface having a varying radial length and said secondary pawl follows said cam surface effecting said movement between the retracted position and the deployed position.

14. A hood latch as claimed in claim 13 wherein said rotatable movement of said secondary release arm between the retracted position and the deployed is responsive to rotation of said ratchet between the primary closed condition and the secondary closed condition.

15. A hood latch as claimed in claim 14 wherein said hood latch further comprises a light means mounted for illuminating a region forward of the hood latch, said light means turning off and on responsively to the ratchet rotating between the primary closed condition and the secondary closed condition.

16. A hood latch as claimed in claim 14 wherein when said secondary release arm is in the retracted position, said secondary release is in a plane generally parallel to said housing and when said secondary release arm is in the deployed position, said secondary release arm is rotated at least 15° thereto.

17. A hood latch as claimed in claim 16 wherein said hood latch further comprises a light means mounted for illuminating a region forward of the hood latch, said light means turning off and on responsively to the ratchet rotating between the primary closed condition and the secondary closed condition.

* * * * *